US007094120B2

(12) United States Patent
Saruta

(10) Patent No.: US 7,094,120 B2
(45) Date of Patent: Aug. 22, 2006

(54) PHOSPHOR SCREEN SUBSTRATE, IMAGE DISPLAY DEVICE USING THE SAME, AND MANUFACTURING METHODS THEREOF

(75) Inventor: Shoshiro Saruta, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 10/413,534

(22) Filed: Apr. 15, 2003

(65) Prior Publication Data

US 2003/0197464 A1 Oct. 23, 2003

(30) Foreign Application Priority Data

Apr. 19, 2002 (JP) ..... 2002-117691

(51) Int. Cl.
*H01J 9/20* (2006.01)

(52) U.S. Cl. ..... 445/24; 445/14; 427/64; 427/123

(58) Field of Classification Search ..... 445/24, 445/14; 427/64, 58, 123
See application file for complete search history.

(56) References Cited

U.S. PATENT DOCUMENTS

| | | | | |
|---|---|---|---|---|
| 3,582,390 | A | 6/1971 | Saulnier | 117/35 |
| 5,800,234 | A * | 9/1998 | Spina et al. | 445/45 |
| 5,874,124 | A * | 2/1999 | Adebayo et al. | 427/64 |
| 6,372,285 | B1 * | 4/2002 | Ito et al. | 427/58 |

FOREIGN PATENT DOCUMENTS

| | | |
|---|---|---|
| JP | 7-130291 | 5/1995 |
| JP | 2000-243270 | 9/2000 |
| JP | 2000-243271 | 9/2000 |

* cited by examiner

*Primary Examiner*—Joseph Williams
*Assistant Examiner*—Matt Hodges
(74) *Attorney, Agent, or Firm*—Fitzpatrick, Cella, Harper & Scinto

(57) ABSTRACT

A phosphor screen substrate is provided in which withstand voltage properties are superior, white uniformity of display image is superior, and luminescence can be efficiently reflected toward the front side. A method for manufacturing such a phosphor screen substrate includes the steps of forming a resin layer on a phosphor layer disposed on a substrate, heating the resin layer to a temperature in the range of from a glass transition temperature of a resin forming the resin layer to the melting point thereof, and forming a metal film on the heated resin layer. The resin layer provided with the metal film thereon is removed by pyrolysis.

3 Claims, 5 Drawing Sheets

PHOSPHOR SCREEN SUBSTRATE, IMAGE DISPLAY DEVICE USING THE SAME, AND MANUFACTURING METHODS THEREOF

BACKGROUND OF THE INVENTION

1. Field of the Invention

The present invention relates to methods for forming phosphor surfaces of image display devices, such as cathode ray tubes (CRT), fluorescent display tubes (VFD), and field emission displays (FED), using luminescence of a phosphor generated by electron-beam emission, and more particularly, relates to a phosphor screen substrate, which has a phosphor layer and a metal film provided thereon, of an image display device and a manufacturing method of the phosphor screen substrate described above.

2. Description of the Related Art

Image display devices using luminescence by electron-beam emission have provided self-luminous bright display devices having superior color reproducibility, and cathode ray tubes (hereinafter referred to as "CRT") have been used practically for these long years. In addition, concomitant with recent diversified information and higher density thereof, further improvements in performance and image quality and increase in screen size have been increasingly required for image display devices. Furthermore, concomitant with the recent aggressive trend toward energy saving and space saving, among various image display devices, a field emission display (hereinafter referred to as "FED"), which is a planar image display device, has particularly drawn attention.

In addition, in CRTs and high-voltage FED at an accelerating voltage of 5 kV or more, in order to effectively remove charges accumulated on a phosphor surface and to effectively reflect phosphor luminescence to a display screen, a metal film is generally formed on a phosphor layer by deposition. In addition, as a metal for forming the metal film, aluminum (Al) has been generally used since electrons are allowed to easily flow thereinto.

It is necessary for the metal film to have no irregularities thereon and to be uniform over the entire screen. The reason for this is that when an image is displayed on the screen, it is important that a display screen having superior white uniformity (hereinafter referred to as "Wu") be formed. Secondly, in order to effectively use luminescence, the metal film preferably has the structure in which the luminescence is effectively reflected to the front side.

In the FED which is a planar image display device, when electrons at a high current density irradiate a phosphor, by this irradiation mentioned above, highly reactive gases are generated. Accordingly, the metal film is expected to inhibit the diffusion of these reactive gases into a vacuum container for protecting various constituent elements such as electron sources and partitions from being contaminated, and from this point of view, thirdly, it has been important that the metal film have a small number of pinholes therein.

In the FED, since a rear substrate provided with electron sources arranged in a matrix and wires for driving the electron sources and a front substrate provided with a phosphor layer thereon are disposed with a very small space, approximately 2 to 8 mm, provided therebetween, and a high voltage of approximately 2 to 18 kV is applied to this space, suppression of discharge generated between the substrates has been an important technical subject. From this point of view, fourthly, it has been important for the metal film formed on the phosphor surface to have a high withstand voltage structure in which discharges generated between the substrates can be suppressed and in which damages done to the substrates by discharges can be reduced as small as possible.

Although the mechanism of this discharge generation has not been understood well, as factors for causing discharges, which are estimated from an empirical point of view, for example, there may be mentioned projections on the substrate, dust approximately 5 μm in diameter, fine particles, scratches or cracks in the surface of a metal film formed by deposition (hereinafter referred to as "metal deposition surface"), and hangnails formed thereby. When discharge is once generated, wrinkles, sags, or liftings formed on the metal deposition surface are selectively damaged. Hence, as a phosphor surface having superior withstand voltage properties, dust and fine particles must not be present thereon, and in addition, scratches, hangnails, cracks, sags, and liftings must not be present on the metal deposition surface.

As a method for forming this metal film, a method comprising the steps of first forming a resin-made intermediate layer (hereinafter referred to as "resin interlayer") on a phosphor surface so that the irregularities thereof is planarized thereby, then depositing a metal, and finally removing the resin interlayer by pyrolysis is generally used. For forming the resin interlayer, as a first method, for example, a method disclosed in Japanese Patent Laid-Open No. 7-13029 1 may be mentioned in which a film of a solvent-based lacquer is formed by spin coating. In particular, the method described above comprises the steps of coating a phosphor surface with an aqueous solution containing, for example, colloidal silica and a surfactant so that the irregularities on the phosphor surface are put in a sufficiently wet state; dissolving a resin, such as polymethacrylate, having superior pyrolyzable properties in a nonpolar solvent such as toluene or xylene together with a plasticizer; spraying the resin solution thud prepared onto the phosphor surface planarized in the wet state mentioned above so that oil in water (o/w) type droplets are placed on the phosphor layer; spreading the droplets by spin coating; and removing water and solvent components by drying.

As a second method, for example, there has been a method as disclosed in U.S. Pat. No. 3,582,390, which comprises the steps of applying an aqueous solution containing colloidal silica, a surfactant, and the like on a phosphor surface so as to put it in a sufficiently wet state, as is the method described above; directly coating the phosphor surface with an aqueous emulsion containing a resin, such as an acrylate copolymer, which has superior pyrolyzable properties; forming a thin film of the aqueous emulsion by spin coating; and removing a water component by drying so as to form a resin interlayer.

In both methods described above, since spin coating is used, when the spin rotation speed is increased while the phosphor surface is in a wet state prior to the formation of the resin interlayer, an infiltrating resin interlayer, that is, a resin interlayer which infiltrates between phosphor particles and is closely brought into contact therewith, can be formed, and hence a metal deposition surface having a high withstand voltage can be formed without any lifting, sags, and the like. However, according to experiments carried by the inventors of the present invention, when the spin rotation speed is merely increased, the degree of infiltration of the resin interlayer varies within an effective area and varies particularly between the central portion and the peripheral portion thereof, and as a result, a uniform phosphor surface having superior white uniformity is difficult to obtain. In addition, the phenomenon described above becomes more observable as the screen size is increased.

In recent years, the two methods described above have been primarily used; however, in addition to those described above, as a third method which can be applied particularly to a planar image display device, for example, there may be mentioned a method disclosed in Japanese Patent Laid-Open No. 2000-243270. The method mentioned above comprises the steps of forming a printing paste having appropriate rheological properties and containing a resin which is to be formed into a resin interlayer; and forming the resin interlayer by directly coating a phosphor screen substrate with this paste using a coating technique such as a screen printing or a doctor blade method. However, according to this method, the phosphor surface cannot be placed beforehand in a wet state for planarization, and hence drying of the paste after coating must be performed as quick as possible. Otherwise, the resin to be formed into the resin interlayer totally infiltrates between the particles of the phosphor, and a result, the resin cannot function as a resin interlayer since a meal film formed thereon may not have a continuous surface in some cases. Hence, although the method described above is used, it has been still difficult to form a resin interlayer having an appropriate degree of infiltration.

In each of the first to the third methods described above, after the resin interlayer is formed, Al is formed on the surface thereof by deposition; however, at the stage of forming the resin interlayer, methods for reducing the generation of discharge and for suppressing damages done onto the phosphor surface during discharge have not been disclosed at all. Accordingly, sags and liftings are likely to be formed on the metal deposition surface to be formed on the resin interlayer, and hence destruction of the metal deposition surface disadvantageously tends to occur during discharge.

Furthermore, as a fourth method, methods have been disclosed in Japanese Patent Laid-Open No. 2000-243271. In the publication described above, for example, there have been mentioned a method comprising the steps of depositing aluminum (Al) on a resin film having superior pyrolyzable properties, and then joining the resin film provided with Al to a phosphor surface by fusion or compression bonding; and a method comprising the steps of depositing a metal on a release film, applying a resin which is to be formed into a resin interlayer on the release film mentioned above by a printing technique or the like, then joining this composite film thus formed to a phosphor surface by fusion bonding, and removing the release film. However, in the methods described above, since a film provided with a metal such as Al deposited thereon is directly bonded to the phosphor screen substrate by thermal fusion, scratches or cracks are likely to be mechanically formed on the metal deposition surface, and as a result, problems may arise in that, for example, wrinkles are easily formed when the film is handled. Furthermore, when contraction of the film in fusion bonding, mechanical impacts generated during compression bonding, and the like are not appropriately taken into consideration, sags and liflings are likely to be formed on the metal deposition surface. As a result, problems may be encountered in that discharge occurs frequently at a low voltage, and the metal deposition film is seriously damaged during the discharge. In addition, according to the methods described above, since Al is deposited beforehand on the resin interlayer, it is more difficult to suppress the generation of discharge and damage done to the phosphor surface during discharge at the stage at which the resin interlayer is formed.

SUMMARY OF THE INVENTION

An object of the present invention is to provide a phosphor screen substrate in which various properties can be fulfilled, for example, withstand voltage properties are superior, white uniformity of display image is superior, and luminescence can be efficiently reflected toward the front side.

A method for manufacturing a phosphor screen substrate, according to the present invention, comprises the steps of: forming a resin layer on a phosphor layer disposed on a substrate; heating the resin layer to a temperature in the range of from a glass transition temperature of a resin forming the resin layer to the melting point thereof; forming a metal film on the heated resin layer; and pyrolyzing the resin layer provided with the metal film thereon.

A method for manufacturing an image display device, according to the present invention, comprises: electron sources; and a phosphor screen substrate which is disposed so as to oppose the electron sources and which has a phosphor layer, wherein the phosphor screen substrate is manufactured by the manufacturing method described above.

In addition, a phosphor screen substrate according to the present invention, comprises: a substrate; a phosphor layer provided thereon; and a metal film provided on the phosphor layer, wherein the difference in height of the metal film on the phosphor layer is in the range of from 20% to less than 100% of the median of distribution of phosphor particles forming the phosphor layer.

Furthermore, an image display device according to the present invention, comprises: electron sources; and a phosphor screen substrate which is disposed so as to oppose the electron sources and which has a phosphor layer, wherein the phosphor screen substrate is the phosphor screen substrate described above.

Further objects, features and advantages of the present invention will become apparent from the following description of the preferred embodiments with reference to the attached drawings.

DESCRIPTION OF THE PREFERRED EMBODIMENTS

Figure 1:
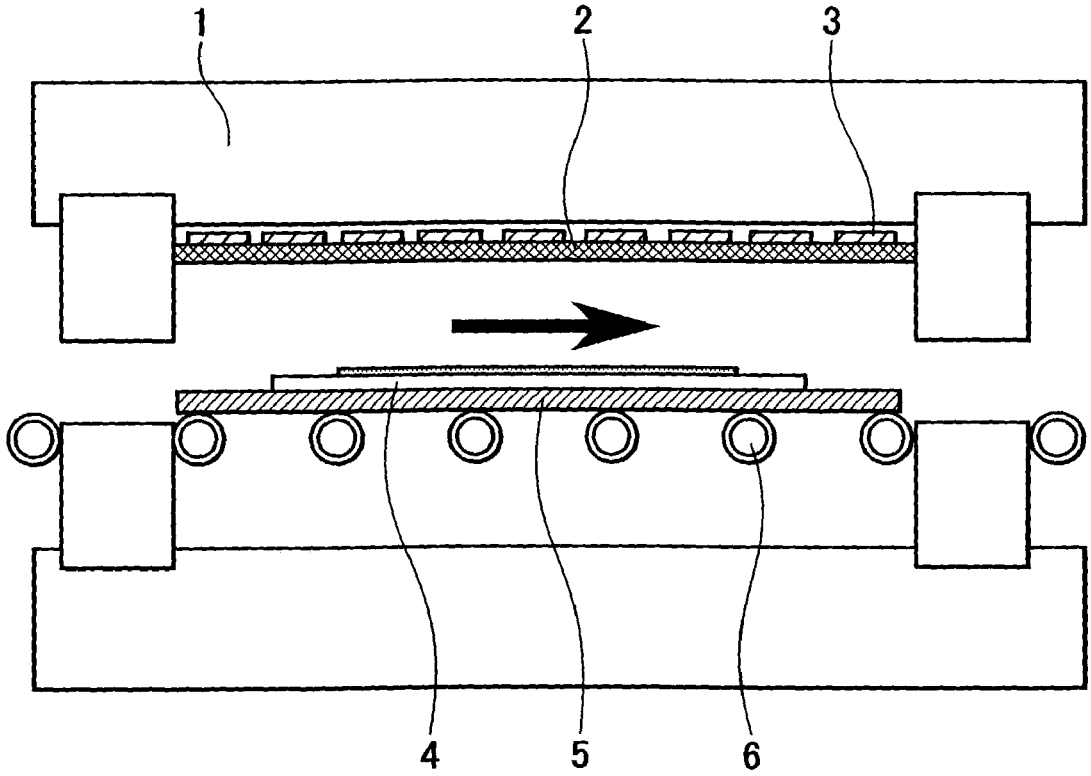
FIG. 1 is a schematic view of a conveyor type infrared heating furnace used in the present invention.

The present invention relates to a method for manufacturing a phosphor screen substrate, the method comprising: a first step of forming a resin layer on a phosphor layer disposed on a substrate; a second step of heating the resin layer to a temperature in the range of from a glass transition temperature of a resin forming the resin layer to the melting point thereof; a third step of forming a metal film on the resin layer thus heated; and a fourth step of pyrolyzing the resin layer provided with the metal film thereon.

The first step may comprise the substeps of placing a surface of the phosphor layer in a wet state, and applying a solution containing the resin onto the surface of the phosphor layer.

The first step may comprise the substeps of: placing a surface of the phosphor layer in a wet state; and applying an aqueous emulsion solution containing the resin onto the surface of the phosphor layer.

The first step may comprise the substep of adhering a resin film onto a surface of the phosphor layer.

The first step may comprise the substeps of: adhering a laminate, which is composed of a release film and the resin layer formed thereon, onto the surface of the phosphor layer so that the resin layer is brought into contact therewith; and then removing the release film.

The second step described above is preferably performed so that the difference in height of the surface of the resin layer, which is obtained after the second step, on the phosphor layer is in the range of from 20% to less than 100% of the median of distribution of phosphor particles forming the phosphor layer.

In addition, the present invention relates to a method for manufacturing an image display device comprising electron sources, and a phosphor screen substrate which is disposed so as to oppose the electron sources and which has a phosphor layer, and this phosphor screen substrate described above is formed by the manufacturing method described above.

In addition, the present invention relates to a phosphor screen substrate comprising a substrate, a phosphor layer provided thereon, and a metal film provided on the phosphor layer, wherein the difference in height of the metal film on the phosphor layer is in the range of from 20% to less than 100% of the median of distribution of phosphor particles forming the phosphor layer.

In addition, the present invention relates to an image display device comprising electron sources, and a phosphor screen substrate which is disposed so as to oppose the electron sources and which is provided with a phosphor layer, and this phosphor screen substrate is the phosphor screen substrate described above.

Since being finally removed from the substrate by pyrolysis, hereinafter the resin layer described above is referred to as a "resin interlayer".

As described above, the manufacturing method of the present invention comprises the second step of heating the resin layer to a temperature in the range of from a glass transition temperature (Tg) of the resin forming the resin layer to the melting temperature thereof. By this second step, the resin interlayer is provided, for example, between phosphor particles and along the difference in height of a phosphor layer so as to be appropriately brought into contact therewith, thereby properly planarizing the irregularities on the surface. As a result, a metal film finally obtained has a large area that adheres to an underlying layer such as the phosphor particles, and hence a metal film having no sags and no liftings can be obtained.

In addition, in the case in which the phosphor layer and a shading layer are disposed on a substrate, as described below, by the second step described above, the resin layer is provided, for example, between the phosphor particles, between particles forming the shading layer, and along the difference in height between the phosphor layer and the shading layer so as to be appropriately brought into contact therewith, thereby properly planarizing the irregularities on the surface. As a result, a metal film finally obtained has a large area that adheres to underlying layers such as the shading layer and the phosphor particles, and hence a metal film having no sags and no liftings can be obtained.

In the step described above, when the heating temperature is lower than the glass transition temperature (Tg), the resin interlayer is unlikely to deform, and hence in order to obtain a resin interlayer which sufficiently infiltrates to improve the withstand voltage, the heating temperature must be set to not less than the glass transition temperature Tg. When the heating temperature is more than the melting point, the resin interlayer melts so rapidly that the control thereof cannot be performed. In addition, in the case described above, when an acrylic resin is used, since depolymerization thereof starts, cracking of the resin interlayer occurs between the phosphor particles and, when the shading layer is provided, at positions at which the differences in height between the surfaces of the phosphor layer and the shading layer are present, and as a result, a discontinuous resin interlayer is formed. Hence, the heating temperature must be in the range of from the glass transition temperature to the melting point of the resin forming the resin interlayer.

In addition, according to the experiments carried out by the inventors of the present invention, when the difference in height of the metal film, which is finally formed on the phosphor surface after the resin interlayer is removed by pyrolysis, is less than 20% of the median (Dm) of distribution of the phosphor particles forming the phosphor layer, a sufficient withstand voltage effect cannot be obtained. In addition, when the difference in height of the metal film is not less than 100% of the Dm, a metal film having many discontinues portions is formed, and as a result, objects to efficiently remove charges accumulated on the phosphor surface and to reflect luminescence emitted from the phosphor to a display surface, which are naturally required for the metal film, cannot be achieved.

Since being formed by deposition or the like, the metal film is deposited approximately along the surface of the resin interlayer. Accordingly, it is preferable that the heating temperature, time, and the like for forming the resin interlayer be appropriately selected so that the difference in height of the surface thereof is in the range of from 20% to less than 100% of the median (Dm) of distribution of the phosphor particles.

Figure 2:
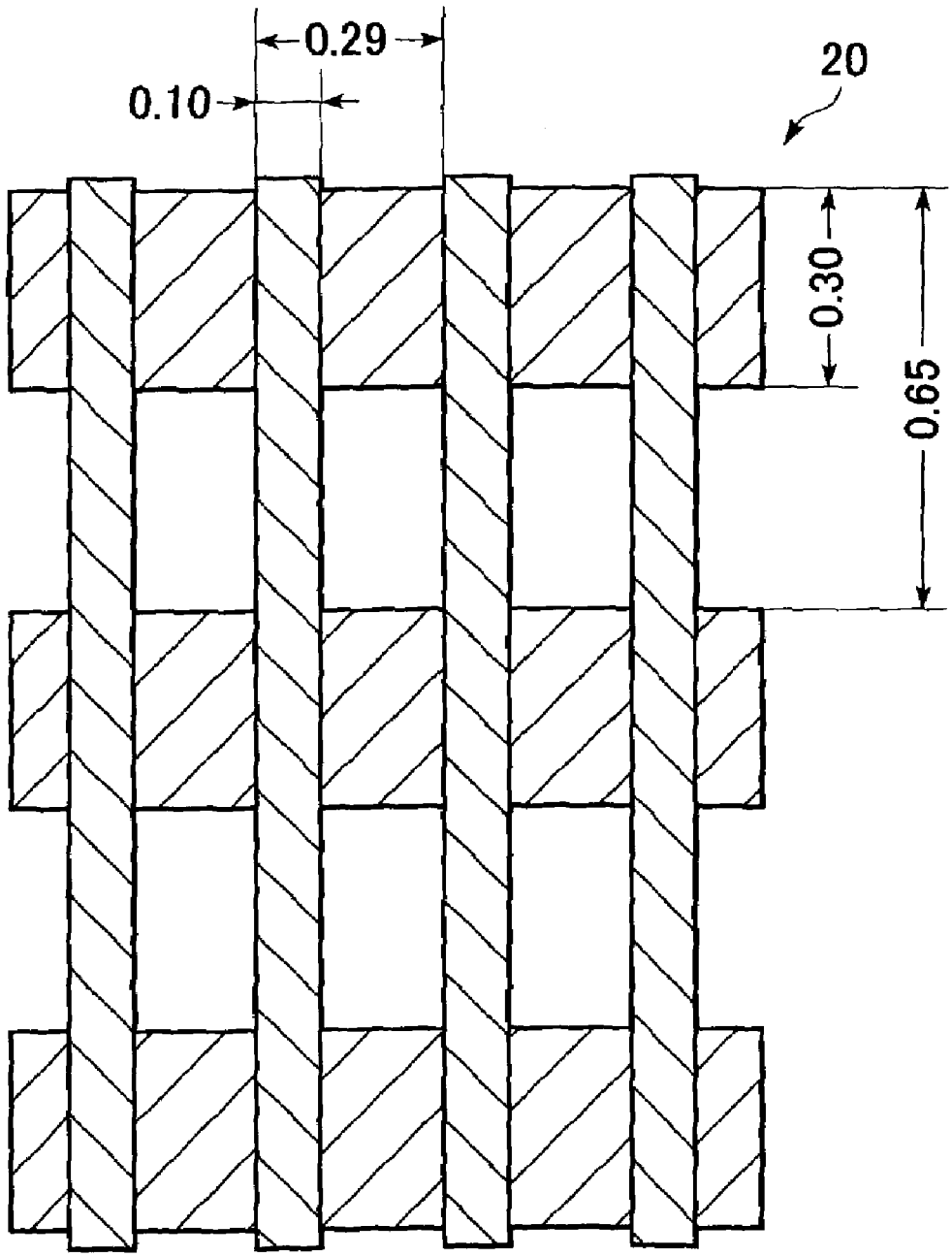
FIG. 2 is a plan view of an example of a black matrix pattern formed on a phosphor screen substrate.

The substrate of the present invention is generally a glass substrate, and on the surface thereof, a monochrome phosphor layer is provided in the case of monochrome display, and in the case of multicolor display, a phosphor layer having a plurality of colors and a shading layer are preferably provided. As the shading layer, for example, a black matrix 20 shown in FIG. 2 having a grating pattern, or a stripe pattern, which is a so-called black stripe, may be formed, and in areas at which the pattern is not formed, a phosphor layer containing various colors, such as blue, green, and red, in the form of dots or strips is formed as a luminescence emitting layer.

As a method for forming the shading layer described above, for example, there may be mentioned a method comprising the steps of forming a film by spin coating using a photoresist such as Noncron 10H manufactured by Tokyo Ohka Kogyo Co., Ltd., followed by drying, exposure, and development, and then applying a dag in which carbon is dispersed as a black pigment followed by development and pyrolysis; a method for forming a pattern of the shading layer by screen printing using a patterning paste containing a metal oxide as a black pigment such as G3-0592 manufactured by Okuno Chemical Industries Co., Ltd.; and a method comprising the steps of performing solid printing of a photosensitive paste containing a metal oxide as a black pigment such as DG-212 manufactured by E. I. Dupont, performing exposure using an appropriate photomask, and performing development to form a pattern.

In addition, as for the phosphor layer, methods generally used for CRTs may be used, for example, there may be mentioned a method comprising the steps of forming films on a substrate by spin coating using slurries, composed of various phosphors dispersed in an aqueous solution together with various surfactants and dispersing agents, the aqueous solution containing, for example, poly(vinyl alcohol) (PVA) and sodium dichromate or ammonium dichromate, and performing exposure and development for individual colors using appropriate photomasks; and a method comprising the steps of adding a small amount of butyl carbitol acetate or the like as a plasticizer to a solvent such as terpineol to form a mixture, dissolving a desired amount of ethyl cellulose in the mixture to form a vehicle having superior thixotropic properties, dispersing various phosphors to this vehicle to form respective pastes, and performing screen printing for individual colors by using the pastes thus formed.

Next, a method for forming the resin interlayer may not be specifically limited as long as, before the metal film is formed, the heating can be performed in the state in which the surface of the substrate, which is provided with the phosphor layer and the black matrix layer, is in close contact with the resin interlayer. That is, as described about the conventional fourth method, according to the method in which the metal film provided on the resin film beforehand is transferred onto the phosphor surface, cracks and wrinkles are generated on the metal film surface during heating, and hence the method cannot be generally used; however, other methods for manufacturing the resin interlayer may be used.

For example, as described above, there may be a method comprising the steps of placing a phosphor surface in a wet state by using an aqueous solution containing, for example, colloidal silica or a surfactant, dissolving a resin, such as polymethacrylate, having superior pyrolyzable properties in a nonpolar solvent such as toluene or xylene together with a plasticizer, spraying the resin solution thud prepared onto the phosphor surface in the wet state mentioned above, spreading the resin solution by spinning, and removing the water and the solvent components by drying; a method comprising the steps of placing a phosphor surface in a wet state by using an aqueous solution containing, for example, colloidal silica or a surfactant, directly coating the phosphor surface with an aqueous emulsion containing a resin, such as an acrylic copolymer, having superior pyrolyzable properties, and spinning the phosphor surface to form the resin interlayer; and a method for forming the resin interlayer on a phosphor screen substrate by a coating technique, such as screen printing or a doctor blade method.

In addition, as a novel method, there may be a method in which a resin film having superior pyrolyzable properties is adhered onto the surface of the phosphor layer. As the method described above, for example, there may be mentioned a method in which a resin film formed beforehand is joined to the phosphor surface by fusion or compression bonding; a method comprising the steps of forming only a resin interlayer by printing or the like on a release film having no metal film thereon, joining the composite film thus formed to the phosphor surface by fusion or compression bonding, and then removing the release film for forming the resin interlayer.

A material for forming the resin interlayer is not specifically limited as long as being suitably used for the methods described above and being pyrolyzed in a subsequent firing step.

The method for heating the resin interlayer is not specifically limited; however, a method capable of uniformly heating the entire resin interlayer is preferably used. When heat distribution occurs, the brightness becomes nonuniform over a display surface, and unfortunately white uniformity is very degraded. In addition, the resin interlayer may be partly melted, and cracking may occur therein, resulting in decrease of the withstand voltage. For example, when a conduction heat transfer system using a hot plate or the like is used, it is preferable that the rate of increase in temperature be set to sufficiently slow, and that the temperature be independently controlled in individual zones which are formed by dividing the entire heating area. In addition, in a convection heat transfer system, it is necessary that convection be generated uniformly above a workpiece, that is, above the phosphor screen substrate. It has been difficult to obtain sufficient heat uniformity, for example, by a method generally used for forming CRTs, in which a substrate is disposed so as to oppose sheathe heaters and is rotated.

As a preferable method, for example, there may be mentioned a method in which the surface of the resin interlayer is heated by infrared rays or the like while being transported by a conveyor. A heating device used in the method described above is shown in FIG. 1 by way of example. In a heating method using the heating device described above, a substrate 4 provided with the phosphor layer and the resin interlayer is placed on a setter 5 so that the resin interlayer is positioned at the upper side, and the substrate 4 is then transported through a heating furnace, surrounded with an insulating material 1, by the conveying using ceramic rollers 6. At the upper portion of the heating furnace, a plurality of infrared ceramic heaters 3 is provided. Since the number of the ceramic heaters thus provided is not one, and the plurality of heaters is used, as described above, the temperature can be independently controlled in individual zones which are formed by dividing the entire heating area, and as a result, more uniform temperature distribution can be obtained. In addition, by infrared radiation through a neoceram glass 2, heating can be performed. According to this method, relatively clean heating can be performed, and in addition, an advantage can be obtained in the dust and fine particles, which may cause discharges, are not generated on the substrate.

In the case described above, the temperature applied to the resin interlayer is controlled in the range of from a glass transition temperature of a composition forming the resin interlayer to the melting point thereof. In addition, the length of the heating furnace and a conveyor transport speed may be optionally determined in consideration of the heating temperature.

As described above, on the resin interlayer provided on the substrate which is heated in the range of from the glass transition temperature Tg to the melting point m.p., a metal film is formed, and the resin interlayer is pyrolyzed by firing and is removed, thereby forming the phosphor screen substrate.

A material used for the metal film is preferably aluminum and is formed generally by one of various deposition methods. The firing method may also be performed in accordance with that performed in the past.

EXAMPLES

The present invention will be described in detail with reference to the following examples.

The difference in height of the surface of the metal film finally formed was measured by using a laser microscope.

Figure 4:
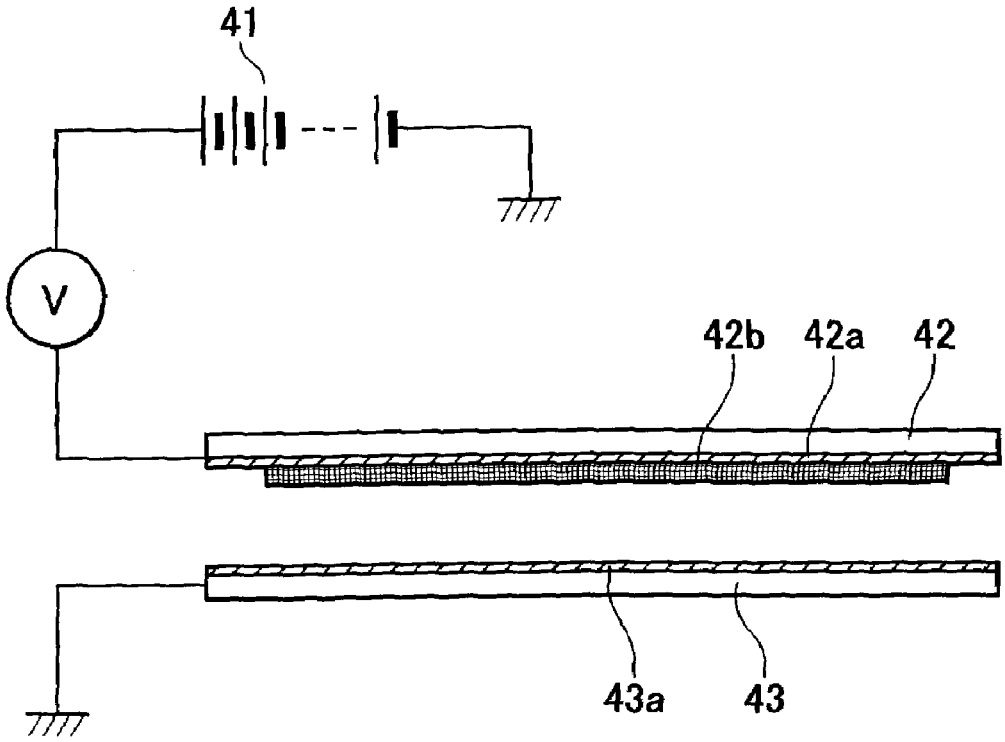
FIG. 4 is a schematic view of an example of a withstand voltage measurement device.

In addition, evaluation of withstand voltage was performed using a withstand voltage measurement device as shown in FIG. 4 in which a discharge voltage at which discharge occurs was measured as described below. In a high vacuum condition, a phosphor surface 42*b* of a phosphor screen substrate 42, which is to be measured, is disposed to oppose a counter substrate 43 with a distance of 2 mm therebetween, and while being increased at a rate of 1 kV/minute by using a direct current voltage source 41, a voltage is applied between an electrode 42*a* of the phosphor screen substrate 42 and an ITO electrode 43*a* of the counter substrate 43 until discharge occurs therebetween.

Example 1

After being immersed in acetone and in isopropyl alcohol, and then being processed with a roll brush using a washing solution and with a disc brush for washing, a soda lime glass 280 mm long, 268 mm wide, and 2.8 mm thick was sufficiently washed by ultra sonic rinsing using pure water and was then dried, thereby obtaining a sufficiently clean glass substrate.

After this glass substrate was placed on a screen printing apparatus, a pattern having 240 stripes, each having a width of 0.10 mm, provided at regular intervals of 0.29 mm in the longitudinal direction and 720 stripes, each having a width of 0.30 mm, provided at regular intervals of 0.65 mm in the lateral direction was formed by screen printing using a black pigment paste (G3-5392 manufactured by Okuno Chemical Industries Co., Ltd.), thereby forming a black matrix 20 provided with openings each having a length of 0.35 mm and a width of 0.19 mm. Subsequently, drying was performed at 95° C. for 10 minutes. Next, after the substrate was again placed on the screen printing apparatus, an Ag paste (NP-4739B manufactured by Noritake Kizai Co., Ltd.) was screen-printed for forming electrode portions to obtain electrical conduction between a high voltage lead electrode and a phosphor surface. After drying was further performed at 95° C. for 10 minutes, firing at 545° C. for 45 minutes was performed, thereby forming a substrate provided with the black matrix and the electrode portions.

In addition, pastes used for printing phosphors having various colors were formed as described below.

First, to 100 parts by weight of terpineol manufactured by The Nippon Koryo Yakuhin Kaisha, Ltd., 7.5 parts by weight of ethyl cellulose (Ethocel N100 manufactured by Hercules Inc.) and 5.2 parts by weight of butyl carbitol acetate (reagent grade, manufactured by Kanto Kagaku Kabushiki Kaisha) were added and were heated to 95° C. while being stirred, thereby forming a vehicle.

To 2.5 parts by weight of the vehicle thus formed, 10 parts by weight of each of various phosphors (P22-HCR2, P22-GN4, and P22-HCB1 manufactured by Kasei Optonix, Ltd., as a red, a green, and a blue phosphor, respectively) and 1.5 parts by weight of terpineol were added and were mixed sufficiently using a planetarium mixer, and subsequently, each mixture was well compounded by a three-roll mill, thereby forming red, green, and blue phosphor pastes.

Figure 3:
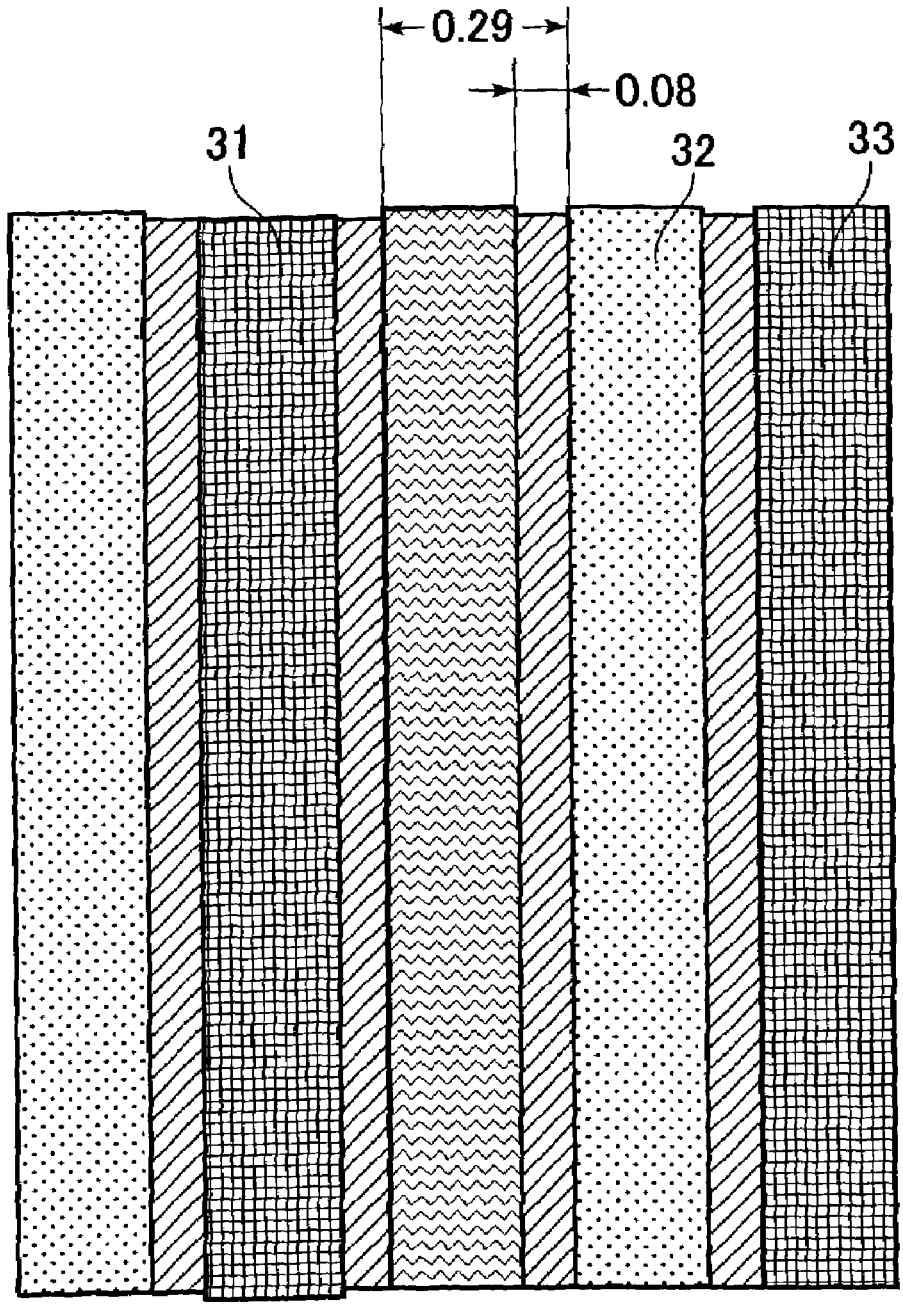
FIG. 3 is a plan view of an example of a pattern of a phosphor layer.

Next, on the substrate provided with the black matrix and the electrode portions, by using the individual red, green, and blue phosphor pastes, as shown in FIG. 3, 240 strips 0.21 mm wide of each of the colors, red, green, and blue (31, 32, and 33) in that order were formed by screen printing at regular intervals of 0.87 mm in the longitudinal direction. After the strips of three colors were individually dried at 95° C. for 100 minutes, firing at 450° C. for 1.5 hours was performed for removing resin components contained in the pastes by pyrolysis thereof, thereby forming the phosphor layer.

Next, after this phosphor layer provided on the substrate was placed on a spin coater, while the coater was rotated at approximately 150 rpm, a colloidal silica solution (Snowtex ST-N manufactured by Nissan Chemical Industries, Ltd.) at a silica concentration of 1 wt % diluted with pure water was uniformly sprayed onto the phosphor layer and was span out, and drying at 110° C. for 1 hour was then performed. After the temperature of the substrate returned to room temperature, the substrate was again placed on the spin coater, pure water was sprayed for 120 seconds at a rotation speed of approximately 150 rpm so that the phosphor layer was put in a sufficiently wet state. Furthermore, onto this phosphor layer, an acryl lacquer solution (2.5 parts by weight of Paraloid B66, manufactured by Rohm and Haas Company, the resin component thereof having a Tg of 50° C. and a melting point of approximately 100° C., dissolved in 1,000 parts by weight of toluene) was sprayed for 8 seconds at a rotation speed of 60 rpm, and then drying was performed, thereby forming the resin interlayer.

Subsequently, the substrate provided with this resin interlayer was placed in a conveyor type infrared heating furnace shown in FIG. 1 and was heated under the conditions in which a setting temperature was 60° C. and a transport speed was 10 mm/second. Furthermore, the substrate was placed in a high-vacuum deposition apparatus, and electron beam (EB) deposition was performed at a deposition rate of 10 Å/second so that an aluminum (Al) film having a thickness of 1,000 Å was formed.

Finally, by firing this substrate at 450° C. for 30 minutes, a phosphor screen substrate provided with the metal film was obtained, the phosphor screen substrate having a diagonal screen size of 10 inches, an aspect ratio of 4 to 3, and 720 by 240 dots.

When this phosphor screen substrate was placed in the withstand voltage measurement device, and the evaluation therefor was performed, no discharge occurred up to 20.3 kV, and it was found that withstand voltage properties sufficient in practice could be obtained. In addition, the difference in height of the surface of the metal film was approximately 2.1 μm, and this difference was 23% of 9.3 μm, which was the median of the particle distribution of the phosphor.

Comparative Example 1

A substrate provided with a resin interlayer, formed in the same manner as that in example 1, was placed in the high-vacuum deposition apparatus, and EB deposition was performed at a deposition rate of 10 Å/second so that an Al film having a thickness of 1,000 Å was formed.

Subsequently, by firing this substrate at 450° C. for 30 minutes, a phosphor screen substrate provided with the metal film was obtained.

By the withstand voltage measurement of this substrate, discharge occurred at 11.3 kV, and it was found that the withstand voltage properties were insufficient as a phosphor screen substrate used for a high-voltage FED. The difference in height of the surface of the metal film was approximately 1.5 μm, and this difference was 16% of 9.3 μm, which was the median of the particle distribution of the phosphor.

Example 2

A substrate provided with a resin interlayer, formed in the same manner as that in example 1, was placed in the conveyor type infrared heating furnace shown in FIG. 1 and was heated under the conditions in which the setting temperature was 80° C. and the transport speed was 10 mm/second. Furthermore, the substrate was placed in the high-vacuum deposition apparatus, and electron beam (EB) deposition was performed at a deposition rate of 10 Å/second so that an Al film having a thickness of 1,000 Å was formed.

Finally, by firing this substrate at 450° C. for 30 minutes, a phosphor screen substrate provided with the metal film was obtained.

According to the withstand voltage measurement for this phosphor screen substrate, no discharge occurred up to 24.3 kV, and it was found that withstand voltage properties sufficient in practice could be obtained. In addition, the difference in height of the surface of the metal film was approximately 8.7 μm, and this difference was 94% of 9.3 μm, which was the median of the particle distribution of the phosphor.

Comparative Example 2

A substrate provided with a resin interlayer, formed in the same manner as that in example 1, was placed in the conveyor type infrared heating furnace shown in FIG. 1 and was heated under the conditions in which the setting temperature was 120° C. and the transport speed was 10 mm/second. Subsequently, the substrate was placed in the high-vacuum deposition apparatus, and EB deposition was performed at a deposition rate of 10 Å/second so that an Al film having a thickness of 1,000 Å was formed.

Finally, by firing this substrate at 450° C. for 30 minutes, a phosphor screen substrate provided with the metal film was obtained.

According to the withstand voltage measurement for this phosphor screen substrate, discharge occurred at 24.6 kV, and it was found that withstand voltage properties sufficient as a phosphor screen substrate used for a high voltage FED could be obtained. However, since the metal deposition surface formed in this comparative example was located far below the phosphor and has no metallic gloss, a practical phosphor screen substrate could not be obtained. In addition, the difference in height of the surface of the metal film was approximately 10.6 μm, and this difference was 114% of 9.3 μm, which was the median of the particle distribution of the phosphor.

Comparative Example 3

A substrate provided with a resin interlayer, formed in the same manner as that in example 1, was placed in the conveyor type infrared heating furnace shown in FIG. 1 and was heated under the conditions in which the setting temperature was 45° C. and the transport speed was 10 mm/second. Subsequently, the substrate was placed in the high-vacuum deposition apparatus, and EB deposition was performed at a deposition rate of 10 Å/second so that an Al film having a thickness of 1,000 Å was formed. Finally, by firing this substrate at 450° C. for 30 minutes, a phosphor screen substrate provided with the metal film was obtained.

According to the withstand voltage measurement for this phosphor screen substrate, discharge occurred at 10.6 kV, and it was found that the withstand voltage properties were insufficient as a phosphor screen substrate used for a high voltage FED. The difference in height of the surface of the metal film was approximately 1.4 μm, and this difference was 15% of 9.3 μm, which was the median of the particle distribution of the phosphor.

Example 3

In the same manner as that in example 1, three phosphors having colors different from each other were formed on a substrate.

In addition, an acrylic resin (Vernish #2 manufactured by Taiyo Ink MFG. CO., LTD., resin component thereof having a Tg of 50° C. and a melting point of 100°) was printed by screen printing on a release film 50 μm thick to form a film having a thickness of 0.5±0.1 μm; this composite film thus formed was disposed so that the printed surface thereof opposed the phosphor surface; a pressure roller heated to approximately 150° C. was scanned at a speed of approximately 80 mm/second on the composite film so as to thermally bond the composite film to the phosphor surface; and the release film was then removed, thereby forming a phosphor screen substrate provided with a resin interlayer. This substrate provided with this resin interlayer was placed in the conveyor type infrared heating furnace shown in FIG. 1 and was heated under the conditions in which the setting temperature was 60° C. and the transport speed was 10 mm/second. Subsequently, the substrate was placed in the high-vacuum deposition apparatus, and EB deposition was performed at a deposition rate of 10 Å/second so that an Al film having a thickness of 1,000 Å was formed. Finally, by firing this substrate at 450° C. for 30 minutes, a phosphor screen substrate provided with the metal film was obtained.

According to the withstand voltage measurement for this phosphor screen substrate, no discharge occurred up to 21.8 kV, and it was found that withstand voltage properties sufficient in practice could be obtained. The difference in height of the surface of the metal film was approximately 2.0 μm, and this difference was 22% of 9.3 μm, which was the median of the particle distribution of the phosphor.

Example 4

A substrate provided with a resin interlayer, formed in the same manner as that in example 3, was placed in the conveyor type infrared heating furnace shown in FIG. 1 and was heated under the conditions in which the setting temperature was 80° C. and the transport speed was 10 mm/second. Subsequently, the substrate was placed in the high-vacuum deposition apparatus, and EB deposition was performed at a deposition rate of 10 Å/second so that an Al film having a thickness of 1,000 Å was formed. Finally, by firing this substrate at 450° C. for 30 minutes, a phosphor screen substrate provided with the metal film was obtained.

According to the withstand voltage measurement for this phosphor screen substrate, no discharge occurred up to 23.7 kV, and withstand voltage properties sufficient in practice could be obtained. The difference in height of the surface of the metal film was approximately 8.9 μm, and this difference was 96% of 9.3 μm, which was the median of the particle distribution of the phosphor.

Comparative Example 4

A substrate provided with a resin interlayer, formed in the same manner as that in example 3, was placed in the high-vacuum deposition apparatus, and EB deposition was performed at a deposition rate of 10 Å/second so that an Al film having a thickness of 1,000 Å was formed. Subsequently, by firing this substrate at 450° C. for 30 minutes, a phosphor screen substrate provided with the metal film was obtained.

According to the withstand voltage measurement for this phosphor screen substrate, discharge occurred at 8.8 kV, and it was found that the withstand voltage properties were insufficient as a phosphor screen substrate used for a high voltage FED. The difference in height of the surface of the metal film was approximately 0.9 μm, and this difference was 10% of 9.3 μm, which was the median of the particle distribution of the phosphor.

Comparative Example 5

A substrate provided with a resin interlayer, formed in the same manner as that in example 3, was placed in the conveyor type heating furnace shown in FIG. 1 and was then heated under the conditions in which the setting temperature was 120° C. and the transport speed was 10 mm/second. Subsequently, the substrate was placed in the high-vacuum deposition apparatus, and EB deposition was performed at a deposition rate of 10 Å/second so that an Al film having a thickness of 1,000 Å was formed. Next, by firing this substrate at 450° C. for 30 minutes, a phosphor screen substrate provided with the metal film was obtained.

According to the withstand voltage measurement for this phosphor screen substrate, discharge occurred in a crack formed therein at a voltage of 6.9 kV, and it was found that the withstand voltage properties were insufficient as a phosphor screen substrate used for a high voltage FED. The difference in height of the surface of the metal film was approximately 12.7 μm, and this difference was 137% of 9.3 μm, which was the median of the particle distribution of the phosphor.

Comparative Example 6

A substrate provided with a resin interlayer, formed in the same manner as that in example 3, was placed in the conveyor type heating furnace shown in FIG. 1 and was then heated under the conditions in which the setting temperature was 45° C. and the transport speed was 10 mm/second. Subsequently, the substrate was placed in the high-vacuum deposition apparatus, and EB deposition was performed at a deposition rate of 10 Å/second so that an Al film having a thickness of 1,000 Å was formed. Next, by firing this substrate at 450° C. for 30 minutes, a phosphor screen substrate provided with the metal film was obtained.

According to the withstand voltage measurement for this phosphor screen substrate, discharge occurred at 10.4 kV, and it was found that the withstand voltage properties were insufficient as a phosphor screen substrate used for a high voltage FED. The difference in height of the surface of the metal film was approximately 1.4 μm, and this difference was 15% of 9.3 μm, which was the median of the particle distribution of the phosphor.

Example 5

In the same manner as that in example 1, three phosphors having colors different from each other were formed on a substrate.

In addition, a polyethylene naphthalate film (Teonex manufactured by Teijin, LTD., having a Tg of 121° C. and a melting point of 269°) having a thickness of 0.6 μm was disposed so that a surface thereof to be printed opposes the phosphor surface and was heated to approximately 150° C. while being compressed thereto with a flat plate made of polytetrafluoroethylene, thereby forming a phosphor screen substrate provided with a resin interlayer. This substrate provided with this resin interlayer was placed in the conveyor type infrared heating furnace shown in FIG. 1 and was heated under the conditions in which the setting temperature was 125° C. and the transport speed was 5 mm/second. Subsequently, the substrate was placed in the high-vacuum deposition apparatus, and EB deposition was performed at a deposition rate of 10 Å/second so that an Al film having a thickness of 1,000 Å was formed. Finally, by firing this substrate at 450° C. for 30 minutes, a phosphor screen substrate provided with the metal film was obtained.

According to the withstand voltage measurement for this phosphor screen substrate, no discharge occurred up to 21.8 kV, and it was found that withstand voltage properties sufficient in practice could be obtained. The difference in height of the surface of the metal film was approximately 2.3 μm, and this difference was 25% of 9.3 μm, which was the median of the particle distribution of the phosphor.

Example 6

A substrate provided with a resin interlayer, formed in the same manner as that in example 5, was placed in the conveyor type infrared heating furnace shown in FIG. 1 and was heated under the conditions in which the setting temperature was 180° C. and the transport speed was 5 mm/second. Subsequently, the substrate was placed in the high-vacuum deposition apparatus, and EB deposition was performed at a deposition rate of 10 Å/second so that an Al film having a thickness of 1,000 Å was formed. Finally, by firing this substrate at 450° C. for 30 minutes, a phosphor screen substrate provided with the metal film was obtained.

According to the withstand voltage measurement for this phosphor screen substrate, no discharge occurred up to 23.7 kV, and withstand voltage properties sufficient in practice could be obtained. The difference in height of the surface of the metal film was approximately 4.5 μm, and this difference was 48% of 9.3 μm, which was the median of the particle distribution of the phosphor.

Comparative Example 7

A substrate provided with a resin interlayer, formed in the same manner as that in example 5, was placed in the high-vacuum deposition apparatus, and EB deposition was performed at a deposition rate of 10 Å/second so that an Al film having a thickness of 1,000 Å was formed. Subsequently, by firing this substrate at 450° C. for 30 minutes, a phosphor screen substrate provided with the metal film was obtained.

According to the withstand voltage measurement for this phosphor screen substrate, discharge occurred at 8.8 kV, and it was found that the withstand voltage properties were insufficient as a phosphor screen substrate used for a high voltage FED. The difference in height of the surface of the metal film was approximately 0.6 μm, and this difference was 6% of 9.3 μm, which was the median of the particle distribution of the phosphor.

Comparative Example 8

A substrate provided with a resin interlayer, formed in the same manner as that in example 5, was placed in the conveyor type heating furnace shown in FIG. 1 and was then heated under the conditions in which the setting temperature was 115° C. and the transport speed was 5 mm/second. Subsequently, the substrate was placed in the high-vacuum deposition apparatus, and EB deposition was performed at a deposition rate of 10 Å/second so that an Al film having a thickness of 1,000 Å was formed. Finally, by firing this substrate at 450° C. for 30 minutes, a phosphor screen substrate provided with the metal film was obtained.

According to the withstand voltage measurement for this phosphor screen substrate, discharge occurred at 12.1 kV, and it was found that the withstand voltage properties were insufficient as a phosphor screen substrate used for a high voltage FED. The difference in height of the surface of the metal film was approximately 1.1 μm, and this difference was 12% of 9.3 μm, which was the median of the particle distribution of the phosphor.

The results of the examples and the comparative examples are shown in Table 1.

TABLE 1

| | Tg of Resin (° C.) | M. P. Resin (° C.) | Setting Temperature of Infrared Furnace (° C.) | Discharge Voltage (kV) | Median of Phosphor Particle Distribution Dm (μm) | Difference in Height of Metal Deposition Film (μm) | Difference in Surface Height Dm (μm) | Others |
|---|---|---|---|---|---|---|---|---|
| Example 1 | 50 | 100 | 60 | 20.3 | 9.3 | 2.1 | 23 | |
| Comparative Example 1 | 50 | 100 | No | 11.3 | 9.3 | 1.5 | 16 | |
| Example 2 | 50 | 100 | 80 | 24.3 | 9.3 | 8.7 | 94 | |
| Comparative Example 2 | 50 | 100 | 120 | 24.6 | 9.3 | 10.6 | 114 | No Al Metallic Gloss |
| Comparative Example 3 | 50 | 100 | 45 | 10.6 | 9.3 | 1.4 | 15 | |
| Example 3 | 50 | 100 | 60 | 21.8 | 9.3 | 2.0 | 22 | |
| Example 4 | 50 | 100 | 80 | 23.7 | 9.3 | 8.9 | 96 | |
| Comparative Example 4 | 50 | 100 | No | 8.8 | 9.3 | 0.9 | 10 | |
| Comparative Example 5 | 50 | 100 | 120 | 6.9 | 9.3 | 12.7 | 137 | Discharge at Al Crack Portion |
| Comparative Example 6 | 50 | 100 | 45 | 10.4 | 9.3 | 1.4 | 15 | |
| Example 5 | 121 | 269 | 125 | 21.8 | 9.3 | 2.3 | 25 | |
| Example 6 | 121 | 269 | 180 | 23.7 | 9.3 | 4.5 | 48 | |
| Comparative Example 7 | 121 | 269 | No | 8.8 | 9.3 | 0.6 | 6 | |
| Comparative Example 8 | 121 | 269 | 115 | 12.1 | 9.3 | 1.1 | 12 | |

By using the phosphor screen substrate formed in one of the examples described above, an image display device shown in FIG. 5 was formed.

Figure 5:
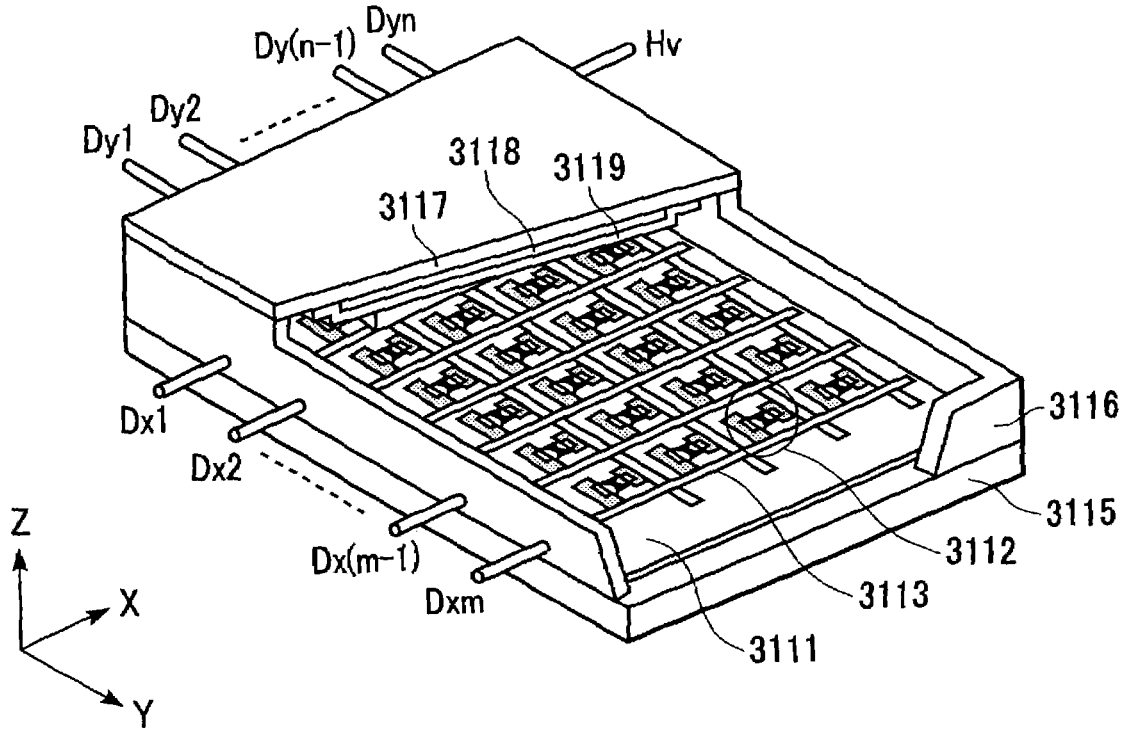
FIG. 5 is a schematic view of an image display device of the present invention.

FIG. 5 is a perspective view showing an example of an image display device. In the figure, reference numerals 3115, 3116, and 3117 indicate a rear plate, a sidewall, and a face plate, respectively, and the rear plate 3115, the sidewall 3116, and the face plate 3117 form a container which maintains a vacuum state inside a display panel. A substrate 3111 is fixed to the rear plate 3115, and on the substrate 3111, a plurality of electron emission elements 3112 are formed. In addition, said plurality of electron emission elements 3112 is wired by M wires 3113 extending in the row direction and N wires 3114 extending in the column direction. In addition, under the face plate 3117, a phosphor layer 3118 is formed, and the phosphor layer 3118 is formed of the phosphor layer containing three primary colors, red (R), green (G), and blue (B), and the black matrix. Furthermore, on the surface of the phosphor layer 3118 at the rear plate 3115 side, a metal back 3119 made of Al is formed. That is, the face plate 3117, the phosphor layer 3118, and the metal back 3119 form the phosphor screen substrate described in each of the examples described above.

In FIG. 5, when one of the phosphor screen substrates of the individual example described above is used as the face plate 3117, the phosphor layer 3118, and the metal back 3119; voltages are applied to the individual electron emission elements 3112 through terminals Dx1 to Dxm and Dy1 to Dyn; and a high voltage ranging from several hundred to several thousand volts is applied to the metal back 3119 through an exterior terminal Hv provided for the container, display image having superior withstand voltage properties and superior white uniformity can be obtained.

Accordingly, the present invention can provide a phosphor screen substrate in which various properties can be fulfilled, for example, withstand voltage properties are superior, white uniformity of display image is superior, and luminescence can be efficiently reflected toward the front side. Hence, in particular, the performance of a planar field emission device having a large screen can be improved, and practical and significant advantages can be obtained, for example, a wall hanging television can be realized.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A method for manufacturing a phosphor screen substrate, comprising the steps of:

applying a liquid containing a resin on a phosphor layer disposed on a substrate;

drying the liquid containing a resin, which is applied on the phosphor layer, so that a resin layer is formed on the phosphor layer;

heating the resin layer formed on the phosphor layer by the drying step by infrared radiation to a temperature in the range of from a glass transition temperature of a resin forming the resin layer to the melting point thereof, wherein the heating step is performed independently from the driving step;

forming a metal film on the heated resin layer; and pyrolyzing the resin layer provided with the metal film thereon, wherein the resin layer forming step comprises the substeps of adhering a laminate, which is composed of a release film and the resin layer formed thereon, onto a surface of the phosphor layer so that the resin layer is brought into contact therewith, and removing the release film, and wherein the resin layer heating step is performed so that the difference in height of the surface of the resin layer, which is obtained after the resin layer heating step, on the phosphor layer is in the range of from 20% to less than 100% of a median of distribution of phosphor particles forming the phosphor layer.

2. A method for manufacturing an image display device comprising the steps of providing electron sources and a phosphor screen substrate disposed so as to oppose the electron sources and which has a phosphor layer, wherein the phosphor screen substrate is manufactured by a method according to claim 1.

3. A method for manufacturing a phosphor screen substrate, comprising the steps of:

applying a liquid containing a resin on a phosphor layer disposed on a substrate;

drying the liquid containing a resin, which is applied on the phosphor layer, so that a resin layer is formed on the phosphor layer;

heating the resin layer formed on the phosphor layer by the drying step to a temperature in the range of from a glass transition temperature of a resin forming the resin layer to the melting point thereof, wherein the heating step is performed independently from the drying step;

forming a metal film on the heated resin layer; and pyrolyzing the resin layer provided with the metal film thereon, wherein the resin layer heating step is performed so that the difference in height of the surface of the resin layer, which is obtained after the resin layer heating step, on the phosphor layer is in the range of from 20% to less than 100% of a median of distribution of phosphor particles forming the phosphor layer.

* * * * *

UNITED STATES PATENT AND TRADEMARK OFFICE

CERTIFICATE OF CORRECTION

PATENT NO. : 7,094,120 B2
APPLICATION NO. : 10/413534
DATED : August 22, 2006
INVENTOR(S) : Shoshiro Saruta It is certified that error appears in the above-identified patent and that said Letters Patent is hereby corrected as shown below:

COLUMN 2:

Line 26, "7-13029 1" should read --7-130291--.
Line 35, "thud" should read --thus--.

COLUMN 7:

Line 39, "thud" should read --thus--.

COLUMN 8:

Line 19, "sheathe" should read --sheath--.

COLUMN 9:

Line 20, "ultra sonic" should read --ultrasonic--.

COLUMN 10:

Line 9, "span" should read --spun--.

COLUMN 12:

Line 11, "(Verninsh #2" should read --(Varnish #2)--.

Signed and Sealed this

Eighteenth Day of March, 2008

JON W. DUDAS
*Director of the United States Patent and Trademark Office*